US007624008B2

(12) United States Patent
Beerends et al.

(10) Patent No.: US 7,624,008 B2
(45) Date of Patent: Nov. 24, 2009

(54) METHOD AND DEVICE FOR DETERMINING THE QUALITY OF A SPEECH SIGNAL

(75) Inventors: John Gerard Beerends, Hengstdijk (NL); Andries Pieter Hekstra, Eindhoven (NL)

(73) Assignee: Koninklijke KPN N.V., The Hague (NL)

( * ) Notice: Subject to any disclaimer, the term of this patent is extended or adjusted under 35 U.S.C. 154(b) by 922 days.

(21) Appl. No.: 10/468,087

(22) PCT Filed: Mar. 1, 2002

(86) PCT No.: PCT/EP02/02342

§ 371 (c)(1),
(2), (4) Date: Nov. 25, 2003

(87) PCT Pub. No.: WO02/073601

PCT Pub. Date: Sep. 19, 2002

(65) Prior Publication Data

US 2004/0078197 A1 Apr. 22, 2004

(30) Foreign Application Priority Data

Mar. 13, 2001 (EP) ..... 01200945

(51) Int. Cl.
*G10L 19/14* (2006.01)
*G10L 21/02* (2006.01)

(52) U.S. Cl. ..... 704/225; 704/224; 704/226

(58) Field of Classification Search ..... 704/200.1, 704/224–226
See application file for complete search history.

(56) References Cited

U.S. PATENT DOCUMENTS 5,345,535 A * 9/1994 Doddington ..... 704/236
6,041,294 A 3/2000 Beerends ..... 704/203
6,232,965 B1 * 5/2001 Scott et al. ..... 715/203
6,246,345 B1 * 6/2001 Davidson et al. ..... 341/51
6,271,771 B1 * 8/2001 Seitzer et al. ..... 341/50
6,308,150 B1 * 10/2001 Neo et al. ..... 704/200.1
6,594,307 B1 * 7/2003 Beerends ..... 375/224
6,940,987 B2 * 9/2005 Claesson ..... 381/107
6,975,671 B2 * 12/2005 Sindhushayana et al. .... 375/144
7,013,266 B1 * 3/2006 Berger ..... 704/203
7,016,814 B2 * 3/2006 Beerends et al. ..... 702/189
7,027,982 B2 * 4/2006 Chen et al. ..... 704/230
7,143,030 B2 * 11/2006 Chen et al. ..... 704/219
7,146,313 B2 * 12/2006 Chen et al. ..... 704/230
7,155,383 B2 * 12/2006 Chen et al. ..... 704/201

(Continued)

OTHER PUBLICATIONS

John Anderson, "Methods for Measuring Perceptual Speech Quality", Agilent Technologies, Network Systems Test Division, Mar. 1, 2001, pp. 1-34.

*Primary Examiner*—Richemond Dorvil
*Assistant Examiner*—Eric Yen
(74) *Attorney, Agent, or Firm*—Michaelson & Associates; Peter L. Michaelson

(57) ABSTRACT

Methods and devices for objectively predicting perceptual quality of speech signals degraded in a speech processing/transporting system which may have poor prediction results for degraded signals including extremely weak or silent portions. Improvement is achieved by applying a first scaling step in a pre-processing stage with a first scaling factor which is a function of a reciprocal value of power of the output signal increased by an adjustment value, and by a second scaling step with a second scaling factor which is substantially equal to the first scaling factor raised to an exponential value and with an adjustment value between zero and one. The second scaling step may be performed at various locations in the device. The adjustment values are adjusted using test signals with well-defined subjective quality scores.

23 Claims, 5 Drawing Sheets

U.S. PATENT DOCUMENTS 7,197,452 B2 * 3/2007 Hands ..... 704/200.1
7,240,001 B2 * 7/2007 Chen et al. ..... 704/230
7,313,517 B2 * 12/2007 Beerends et al. ..... 704/200
7,366,663 B2 * 4/2008 Beerends et al. ..... 704/231
7,426,466 B2 * 9/2008 Ananthapadmanabhan et al. ..... 704/230
2002/0193999 A1 * 12/2002 Keane et al. ..... 704/270
2003/0055608 A1 * 3/2003 Beerends et al. ..... 702/189

* cited by examiner

METHOD AND DEVICE FOR DETERMINING THE QUALITY OF A SPEECH SIGNAL

A. BACKGROUND OF THE INVENTION

1. Field of the Invention

The invention lies in the area of quality measurement of sound signals, such as audio, speech and voice signals. In particular, it relates to a method and a device for determining, according to an objective measurement technique, the speech quality of an output signal as received from a speech signal processing system, with respect to a reference signal.

2. Description of the Prior Art

Methods and devices of such type are known, e.g., from References [1, - - - , 5] (for more bibliographic details on the References, see below under C. References). Methods and devices, which follow the ITU-T Recommendation P.861 or its successor Recommendation P.862 (see References [6] and [7]), are also of such a type. According to the present known technique, an output signal from a speech signals processing and/or transporting system, such as wireless telecommunications systems, Voice over Internet Protocol transmission systems, and speech codecs, which is generally a degraded signal and whose signal quality is to be determined, and a reference signal, are mapped onto representation signals according to a psycho-physical perception model of the human hearing. As a reference signal, an input signal of the system applied with the output signal obtained may be used, as in the cited references. Subsequently, a differential signal is determined from the representation signals, which, according to the perception model used, is representative of a disturbance sustained in the system and present in the output signal. The differential or disturbance signal constitutes an expression for the extent to which, according to the representation model, the output signal deviates from the reference signal. Then, the disturbance signal is processed in accordance with a cognitive model, in which certain properties of human test subjects have been modelled, in order to obtain a time-independent quality signal, which is a measure of the quality of the auditive perception of the output signal.

The known technique, and more particularly methods and devices which follow the Recommendation P.862, have, however, the disadvantage that severe distortions caused by extremely weak or silent portions in the degraded signal, and which contain speech in the reference signal, may result in a quality signal which possesses a poor correlation with subjectively determined quality measurements, such as mean opinion scores (MOS) of human test subjects. Such distortions may occur as a consequence of time clipping, i.e., replacement of short portions in the speech or audio signal by silence, e.g., in case of lost packets in packet switched systems. In such cases, the predicted quality is significantly higher than the subjectively perceived quality.

B. SUMMARY OF THE INVENTION

An object of the present invention is to provide an improved method and corresponding device for determining the quality of a speech signal which do not possess this disadvantage.

The present invention has been based, among other things, on the following observation. The gain of a system under test is generally not known a priori. Therefore, in an initialization or pre-processing phase of a main step of processing the output (degraded) signal and the reference signal, a scale step is carried out, at least on the output signal by applying a scaling factor for an overall or global scaling of the power of the output signal to a specific power level. The specific power level may be related to the power level of the reference signal in techniques such as following Recommendation P.861, or to a predefined fixed level in techniques which follow Recommendation P.862. The scale factor is a function of the reciprocal value of the square root of the average power of the output signal. In cases in which the degraded signal includes extremely weak or silent portions, this reciprocal value increases to a large number. It is this behavior of the reciprocal value of such a power related parameter, that can be used to adapt the distortion calculation in such a manner that a much better prediction of the subjective quality of systems under test is possible.

A further object of the present invention is to provide a method and a device of the above kind, which comprise scaling operation having enhanced control and means for such a scaling operation, respectively.

This and other objects are achieved by introducing in a method and device of the above kind an additional, second scale step carried out by applying a second scaling factor, using at least one adjustment parameter, but preferably two adjustment parameters. In the preferred case, the second scale factor is a function of a reciprocal value of a power related parameter raised to an exponent with a value corresponding to a first adjustment parameter, in which function the power related parameter is increased with a value corresponding to a second adjustment parameter. The second scaling step may be carried out in various stages of the method and device.

The use of a scale factor, which is a function of a reciprocal value of a power related parameter such as the known square root of the average power of the output signal, has still a further shortcoming. Unfortunately, other situations still exist which will lead to unreliable speech quality predictions. One such situation is the following. Two degraded speech signals, which are the output signals of two different speech signal processing systems under test, and which have the same input reference signal, may have the same value for the average power. For example, one of the signals has a relatively large power but only during a relatively short portion of a total duration of the speech signal and extremely low or zero power elsewhere, whereas the other signal has a relative low power during the total speech duration. Such degraded signals may have essentially the same prediction of the speech quality, but they may differ considerably in the subjectively experienced speech quality.

A still further object of the present invention is to provide a method and a device of the above kind, in which a scale factor is introduced, which will lead to reliable speech quality predictions also in cases where different degraded signals occur but which, as mentioned above, have essentially equal power average values.

These and still other objects are achieved by introducing in the first and/or second scaling operations, the use of two new scale factors based on power related parameters which differ from the average signal power. A first new scale factor is a function of a new power related parameter, called signal power activity (SPA), which is defined as a total time duration during which the power of a particular signal is above or equal to a predefined threshold value. The first new scale factor is defined for scaling the output signal in the first scaling operation and is a function of the reciprocal value of the SPA of the output signal. Preferably, the first new scale factor is a function of the ratio of the SPA of the reference signal and the SPA of the output signal. This first new scale factor may be used instead of or in combination (e.g., in multiplication) with the known scale factor based on the average signal power. The second new scale factor is derived from what may be called a local scaling factor, i.e., the ratio of instantaneous powers of the reference and output signals, in which adjustment parameters are introduced on a local level. A local version of the second new scale factor may be applied in the second scaling operation as carried out directly to the, still time-dependent, differential signal during and in a combining stage of the method and device, respectively. A global version of the second new scale factor is achieved by first averaging the local scale factor over the total duration of the speech signal, and then applying the averaged factor in the second scaling operation as carried out during and in the signal combining stage, instead of or in combination with a scaling operation which applies a scale factor derived from the (known and/or first new) scale factor applied in the first scaling operation.

The first new scale factor is more advantageous in cases of degraded speech signals that have portions with extremely low or zero power over relatively long durations, whereas the second new scale factor is more advantageous for such signals that have similar portions over relatively short durations.

C. REFERENCES

[1] Beerends J. G., Stemerdink J. A., "A perceptual speech-quality measure based on a psychoacoustic sound representation", J. Audio Eng. Soc., Vol. 42, No. 3, December 1994, pp. 115-123;

[2] WO-A-96/28950;

[3] WO-A-96/28952;

[4] WO-A-96/28953;

[5] WO-A-97/44779;

[6] ITU-T Recommendation P.861, "Objective measurement of Telephone-band (330-3400 Hz) speech codecs", 06/96;

[7] ITU-T Recommendation P.862 (02/2001), Series P: Telephone Transmission Quality, Telephone Installations, Local Line Networks; Methods for objective and subjective assessment of quality—Perceptual evaluation of speech quality (PESQ), an objective method for end-to-end speech quality assessment of narrow-band telephone networks and speech codecs.

The References [1], - - - , [7] are incorporated by reference into the present application.

D. BRIEF DESCRIPTION OF THE DRAWING

The invention will be further explained by means of the description of exemplary embodiments, reference being made to the following figures:

FIG. 1 schematically shows a known system, including a device, for determining the quality of a speech signal;

E. DESCRIPTION OF EXEMPLARY EMBODIMENTS

Figure 1:
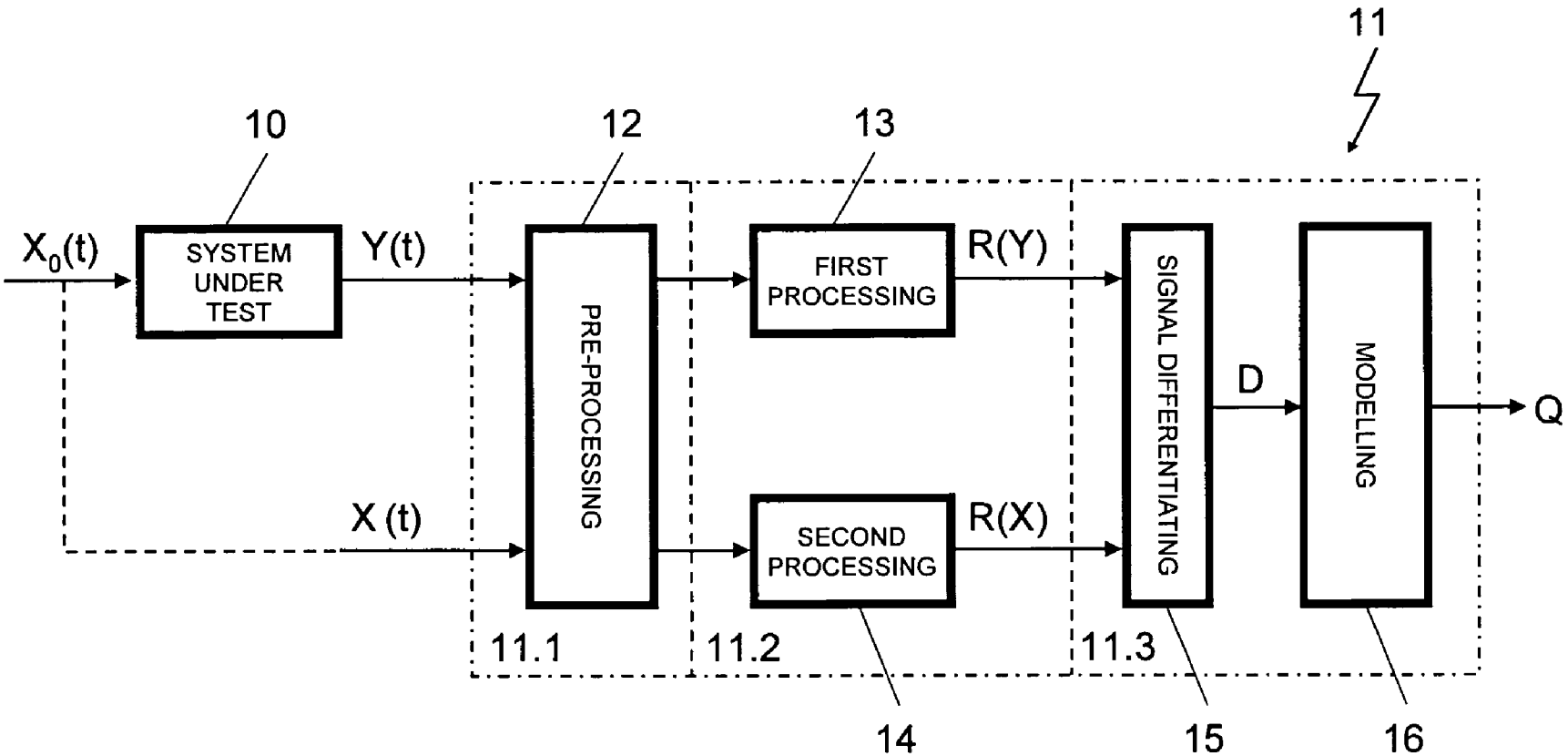
FIG. 1 (Prior Art)

FIG. 1 schematically shows a known implementation of an application of an objective measurement technique which is based on a model of human auditory perception and cognition, such as one which follows any of the ITU-T Recommendations P.861 and P.862, for estimating the perceptual quality of speech links or codecs. This implementation comprises a system or telecommunications network under test 10 (simply "system 10" hereinafter), and a quality measurement device 11 for the perceptual analysis of speech signals offered. A speech signal $X_0(t)$ is used, on the one hand, as an input signal of system 10 and, on the other hand, as a first input signal X(t) of the device 11. An output signal Y(t) of system 10, which in fact is the speech signal $X_0(t)$ affected by system 10, is used as a second input signal of the device 11. An output signal Q of the device 11 represents an estimate of the perceptual quality of the speech link through system 10. Since the input end and the output end of a speech link, particularly in the event it runs through a telecommunications network, are remote from each other, then, for the input signals of the quality measurement device, use is made in most cases of speech signals X(t) stored on data bases. Here, as is customary, the term "speech signal" is understood to mean each sound basically perceptible to human hearing, such as speech and tones. The system under test (system 10) may of course also be a simulation system, which simulates e.g., a telecommunications network. The device 11 carries out a main processing step which comprises successively, in a pre-processing section 11.1, a step of pre-processing carried out by pre-processing means 12, in a processing section 11.2, a further processing step carried out by first and second signal processing means 13 and 14, and, in a signal combining section 11.3, a combined signal processing step carried out by signal differentiating means 15 and modelling means 16. In the pre-processing step, the signals X(t) and Y(t) are prepared for the step of further processing in means 13 and 14, the pre-processing including power level scaling and time alignment operations. The further processing step performed by means 13 and 14 includes mapping of the (degraded) output signal Y(t) and the reference signal X(t) on representation signals R(Y) and R(X) according to a psycho-physical perception model of the human auditory system. During the combined signal processing step provided by means 15 and 16, a differential or disturbance signal D is determined by the differentiating means 15 from the representation signals, which is then processed by modelling means 16 in accordance with a cognitive model, in which certain properties of human test subjects have been modelled, in order to obtain the quality signal Q.

Recently, it has been experienced that the known technique, and more particularly that of Recommendation P.862, has a serious shortcoming in that severe distortions caused by extremely weak or silent portions in the degraded signal, and which are not present in the reference signal, may result in quality signals Q, which predict the quality as being significantly higher than actual subjectively perceived quality and therefore possess poor correlations with subjectively determined quality measurements, such as mean opinion scores (MOS) of human test subjects. Such distortions may result from time clipping, i.e., replacement of short portions in the speech or audio signal by silence, e.g., in case of lost packets in packet switched systems.

Since the gain of a system under test is generally not known a priori, during the initialization or pre-processing phase, a scaling step is carried out, at least on the (degraded) output signal by applying a scale factor for scaling the power of the output signal to a specific power level. The specific power level may be related to the power level of the reference signal in techniques such as in Recommendation P.861. Scaling means 20 for such a scaling step has been shown schematically in FIG. 2. The scaling means 20 have the signals X(t) and Y(t) as input signals, and signals $X_S(t)$ and $Y_S(t)$ as output signals. The scaling is such that the signal $X(t)=X_S(t)$ is unchanged and the signal Y(t) is scaled to $Y_S(t)=S_1 \cdot Y(t)$ in scaling unit 21, applying a scale factor given by equation (1) as follows:

$$S_1=S(X,Y)=\sqrt{P_{\text{average}}(X)/P_{\text{average}}(Y)} \quad \{1\}$$

In this formula, $P_{average}(X)$ and $P_{average}(Y)$ mean time-averaged power of the signals X(t) and Y(t), respectively.

The specific power level may also be related to a predefined fixed level in techniques which follow Recommendation P.862. Scaling means 30, for such a scaling step, is shown schematically in FIG. 3. The scaling means 30 have the signals X(t) and Y(t) as input signals, and signals $X_S(t)$ and $Y_S(t)$ as output signals. The scaling is such that the signal X(t) is scaled to $X_S(t)=S_2 \cdot X(t)$ in scaling unit 31 and the signal Y(t) is scaled to $Y_S(t)=S_3 \cdot Y(t)$ in scaling unit 32, respectively by applying scale factors given by equations (2) and (3) as follows:

$$S_2=S(P_f,X)=\sqrt{P_{\text{fixed}}/P_{\text{average}}(X)} \quad \{2\}$$

and $$S_3=S(P_f,Y)=\sqrt{P_{\text{fixed}}/P_{\text{average}}(Y)} \quad \{3\}$$

in which $P_{fixed}$ (i.e., $P_f$) is a predefined power level, the so-called constant target level, and $P_{average}(X)$ and $P_{average}(Y)$ have the same meaning as set forth above.

In both cases, scale factors are used which are a function of the reciprocal value of a power related parameter, i.e., the square root of the power of the output signal, for $S_1$ and $S_3$, or of the power of the reference signal, for $S_2$. In cases in which the degraded signal and/or the reference signal includes large parts of extremely weak or silent portions, such power related parameters may decrease to very small values or even zero, and consequently the reciprocal values thereof may increase to very large numbers. This fact provides a starting point for making the scaling operations, and preferably also the scale factors used therein, adjustable and consequently enhanced controllability.

In order to achieve such enhanced controllability at first a further, second scaling step is introduced by applying a further, second scale factor. This second scale factor may be chosen to be equal to (but not necessary, see below) the first scale factor, as used for scaling the output signal in the first scaling step, but raised to an exponent $\alpha$. The exponent $\alpha$ is a first adjustment parameter having values preferably between zero and 1. It is possible to carry out the second scaling step on various stages in the quality measurement device (see below). Second, a second adjustment parameter $\Delta$, having a value$\geqq 0$, may be added to each time-averaged signal power value as used in the scale factor or factors, respectively in the first and second one of the two described prior art cases. The second adjustment parameter $\Delta$ has a predefined adjustable value in order to increase the denominator of each scale factor to a larger value, especially in the cases as mentioned above of extremely weak or silent portions. The scale factor(s) thus modified (for $\Delta \neq 0$), or not (for $\Delta=0$), is (are) used in the first scaling step of the initialization phase in a similar way as previously described with reference to FIGS. 2 and 3, as well as in the second scaling step. Hereinafter, three different ways are described with reference to FIG. 4 and FIG. 5, for which the second scale factor is derived from the first scale factor, followed by a description with reference to FIG. 6 and FIG. 7 of some ways in which this is not the case.

Figure 2:
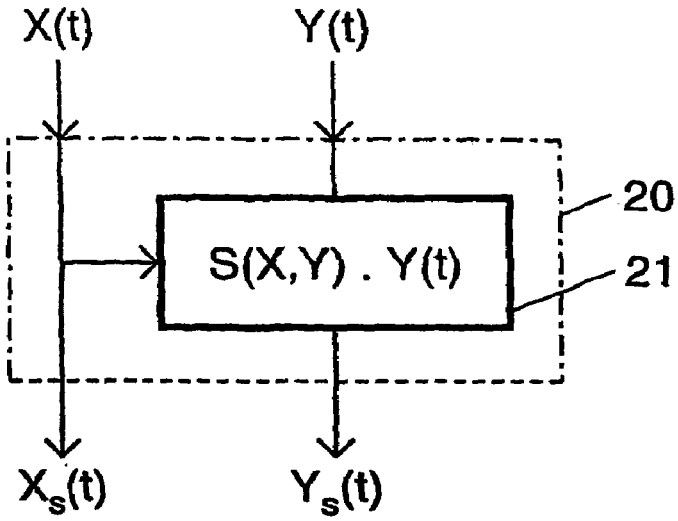
FIG. 2 (Prior Art)
FIG. 2 shows a block diagram of a known device for determining the quality of a speech signal.
Figure 3:
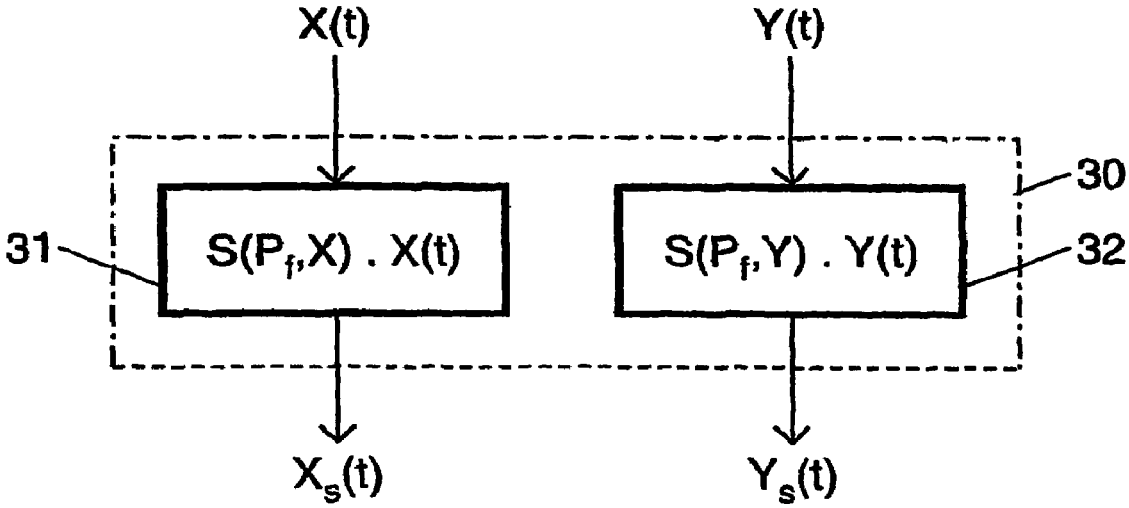
FIG. 3 (Prior Art)
FIG. 3 shows a block diagram of similar detail as shown in FIG. 2, of another known device.
Figure 4:
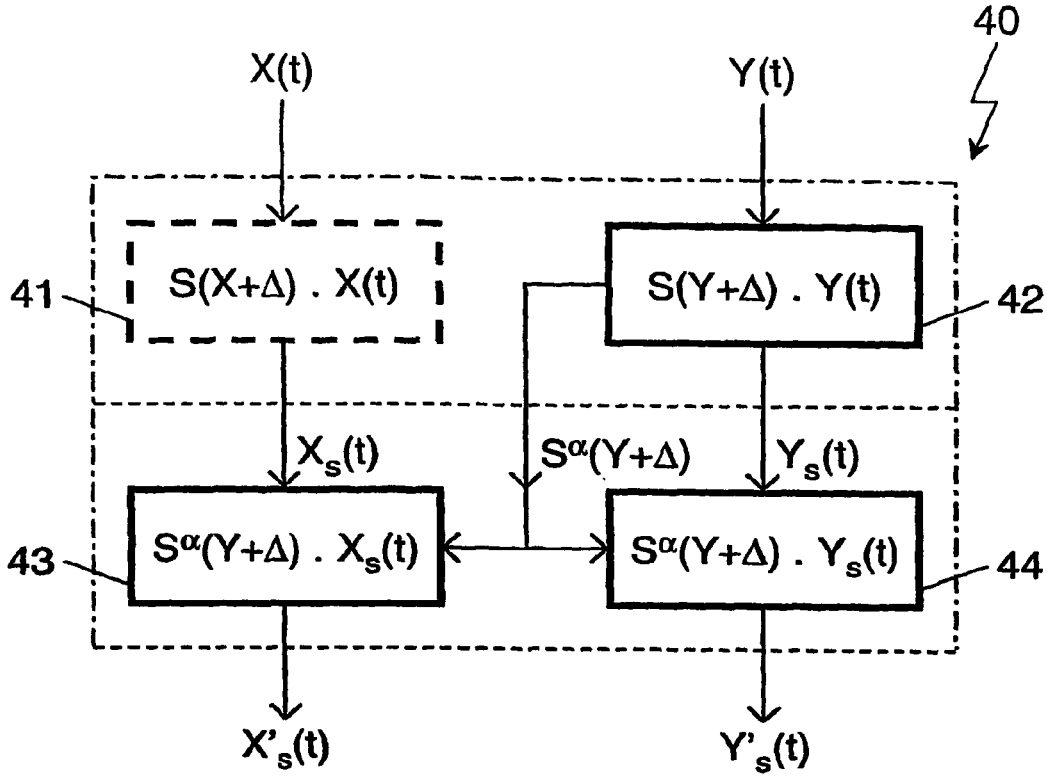
FIG. 4 shows a block diagram of a device for determining quality of a speech signal according to the invention.

FIG. 4 schematically shows a scaling arrangement 40 for carrying out the first scaling step by applying modified scale factors and the second scaling step. The scaling arrangement 40 have the signals X(t) and Y(t) as input signals, and signals $X'_S(t)$ and $Y'_S(t)$ as output signals. The first scaling step is such that the signal X(t) is scaled to $X_S(t)=S'_2 \cdot X(t)$ in scaling unit 41 and the signal Y(t) is scaled to $Y_S(t)=S'_3 \cdot Y(t)$ in scaling unit 42, respectively by applying modified scale factors as given by equations (1'-3') below:

$$S'_1=S(Y+\Delta)=\sqrt{(P_{\text{average}}(X)+\Delta)/(P_{\text{average}}(Y)+\Delta)} \quad \{1'\}$$

for cases having a scaling step in accordance with FIG. 2, in which $X_s(t)=X(t)$ (i.e. $S(X+\Delta)=1$ in FIG. 4), and $$S'_2=S(X+\Delta)=\sqrt{P_{\text{fixed}}/(P_{\text{average}}(X)+\Delta)} \quad \{2'\}$$

and $$S'_3=S(Y+\Delta)=\sqrt{P_{\text{fixed}}/(P_{\text{average}}(Y)+\Delta)} \quad \{3'\}$$

for cases having a scaling step in accordance with FIG. 3.

The second scaling step is such that the signal $X_s(t)$ is scaled to $X'_S(t)=S_4 \cdot X_s(t)$ in scaling unit 43 and the signal $Y_s(t)$ is scaled to $Y'_S(t)=S_4 \cdot Y_s(t)$ in scaling unit 44, by applying scale factor as given by equation (4) below:

$$S_4=S^{\alpha}(Y+\Delta) \quad \{4\}$$

The scale factor $S_4$ may be generated by the scaling unit 42 and passed to the scaling units 43 and 44 of the second scaling step as pictured. Otherwise, the scale factor $S_4$ may be produced by the scaling units 43 and 44 in the second scaling step by applying the scale factor $S_3$ as received from the scaling unit 42 in the first scaling step.

It will be appreciated that the first and second scaling steps carried out within the scaling arrangement 40 may be combined to a single scaling step carried out on the signals X(t) and Y(t) by scaling units, which are combinations respectively of the scaling units 41 and 43, and scaling units 42 and 44, by applying scale factors which are the products of the scale factors used in the separate scaling units. Such a combined scaling step, in which the parameters are chosen as $-1 \leqq \alpha \leqq 0$ and $\Delta \geqq 0$, will be equivalent to a case in which only the first scaling step is present, which applies a scale factor in which the reciprocal value of the power related parameter is raised to an exponent corresponding to an adjustment parameter $\alpha'$ with $0<(\alpha'=1+\alpha) \leqq 1$ and the power related parameter is increased with an adjustment value corresponding to the parameter $\Delta$.

The values of the parameters $\alpha$ and $\Delta$ are adjusted in such a way that for test signals X(t) and Y(t) the objectively measured qualities have high correlations with the subjectively perceived qualities (MOS). Thus, examples of degraded signals with replacement speech by silences up to 100% appeared to give correlations above 0.8, whereas the quality of the same examples as measured in the known way showed values below 0.5. Moreover, there appeared indifference for cases for which the Recommendation P.862 was validated.

The values for the parameters $\Delta$ and $\Delta$ may be stored in the pre-processor means of the measurement device. However, adjusting of the parameter $\Delta$ may also be achieved by adding an amount of noise to the degraded output signal at the entrance of the device 11, in such a way that the amount of noise has an average power equal to the value needed for the adjustment parameter $\Delta$ in a specific case.

Instead of implementing the second scaling step in the pre-processing phase, the second scaling step may be carried out in a later stage during the processing of the output and reference signals. However, the location of the second scaling step does not need to be limited to the stage in which the signals are separately processed. The second scaling step may also be carried out in the signals combining stage, however with different values for the parameters $\alpha$ and $\Delta$. Such is pictured in FIG. 5, which schematically shows a measurement device 50 which is similar as the measurement device 11 of FIG. 1, and which successively comprises a pre-processing section 50.1, a processing section 50.2 and a signal combining section 50.3. The pre-processing section 50.1 includes the scaling units 41 and 42 of the first scaling step, the unit 42 producing the scaling factor $S_4$ (see formula {4}) indicated in the figure by $S^{\alpha i}(Y+\Delta_i)$, in which i=1, 2 for a first and a second case, respectively.

In the first case (i=1), the second scaling step is carried out, in the signal combining section 50.3, by scaling unit 51 and by applying the scale factor $S_4=S^{\alpha 1}(Y+\Delta_1)$, thereby scaling the differential signal D to a scaled differential signal $D'=S^{\alpha 1}(Y+\Delta_1)\cdot D$.

Alternatively, in the second case (i=2) the second scaling step is carried out, again in the signal combining section 50.3, by scaling unit 52 and by applying the scale factor $S_4=S^{\alpha 2}(Y+\Delta_2)$, thereby scaling the quality signal Q to a scaled quality signal $Q'=S^{\alpha 2}(Y+\Delta_2)\cdot Q$.

For the parameters $\alpha_i$ and $\Delta_i$, the same applies as what has been mentioned previously in relation to the parameters $\alpha$ and $\Delta$.

Instead of as an alternative, the scaling step of the second case (i=2) may be carried out also as a third scaling step additional to the second scaling step of the first case (i=1), however with different suitable adjustment parameters.

Further improvements are achieved by introducing, in the first and/or second scaling operations, two new scale factors based on power related parameters which differ from the average signal power.

A first new kind of scale factor may be defined and applied in the first scaling step, and also in the second scaling step, which is based on a different parameter related to the power of the signal X(t) and/or the signal Y(t). Instead of using a time-averaged power $P_{average}$ of the signals X(t) and Y(t) as in the formulas {1}, - - - , {3} and {1+}, - - - , {3'}, a different power related parameter may be used to define a scale factor for scaling the power of the (degraded) output signal to a specific power level. This different power related parameter is called "signal power activity" (SPA). The signal power activity of a speech signal Z(t) is indicated as SPA(Z), meaning the total time duration during which the power of the signal Z(t) is at least equal to a predefined threshold power level $P_{thr}$.

A mathematical expression of the SPA of a signal Z(t) of total duration T is given by equation (5) as follows:

$$SPA(Z) = \int_0^T F(t)dt \qquad \{5\},$$

in which F(t) is a step function as follows:

$$F(t) = \begin{cases} 1 & \text{for all } 0 \le t \le T \text{ for which } P(Z(t)) \ge P_{tr} \\ 0 & \text{for all } 0 \le t \le T \text{ for which } P(Z(t)) < P_{tr} \end{cases}$$

In this, P(Z(t)) indicates the instantaneous power of the signal Z(t) at the time t, and $P_{tr}$ indicates a predefined threshold value for the signal power.

The expression {5} for the SPA is suitable for processing a continuous signal. An expression which is suitable in processing a discrete signal using time frames is given by:

$$SPA(Z) = \sum_{i=1}^{N} F(t_i) \qquad \{5'\},$$

in which $F(t_i)$ is a step function as follows:

$$F(t_i) = \begin{cases} 1 & \text{if } P(Z(t)) \ge P_{tr} \text{ for any } t \text{ with } t_{i-1} < t \le t_i \\ 0 & \text{if } P(Z(t)) < P_{tr} \text{ for all } t \text{ with } t_{i-1} < t \le t_i \end{cases}$$

and in which $t_i=(i/N)T$ for i=1, - - - , N and to =0, and N is the total number of time frames into which the signal Z(t) is divided for processing. Calling a time frame for which $F(t_i)=1$ an "active frame", then formula {5'} counts the total number of active frames in the signal Z(t).

Using the power related parameter SPA thus defined, new scale factors are defined in a similar way as the scale factors of formulas {1}, - - - , {3}, {1'}, - - - , {3+} and {4}, either to replace them, or to be used in multiplication with them. These new scale factors are as follows:

$$T_1=T(X,Y)=\mathrm{SPA}(X)/\mathrm{SPA}(Y) \qquad \{6.1\}$$

$$T_2=T(\mathrm{SPA}_f,X)=\mathrm{SPA}_{fixed}/\mathrm{SPA}(X) \qquad \{6.2\}$$

$$T_3=T(\mathrm{SPA}_f,Y)=\mathrm{SPA}_{fixed}/\mathrm{SPA}(Y) \qquad \{6.3\}$$

$$T_1=T(Y+\Delta)=\{\mathrm{SPA}(X)+\Delta\}/\{\mathrm{SPA}(Y)+\Delta\} \qquad \{6.1'\}$$

$$T'_2=T(X+\Delta)=\mathrm{SPA}_{fixed}/\{\mathrm{SPA}(X)+\Delta\} \qquad \{6.2'\}$$

$$T'_3=T(Y+\Delta)=\mathrm{SPA}_{fixed}/\{\mathrm{SPA}(Y)+\Delta\} \qquad \{6.3'\},$$

and $$T_4=T^{\alpha}(Y+\alpha) \qquad \{6.4\}$$

In this, $\mathrm{SPA}_{fixed}$ (i.e., $\mathrm{SPA}_f$) is a predefined signal power activity level which may be chosen in a similar way as the predefined power level $P_{fixed}$ mentioned before.

Since the thus defined scale factors are also a function of a reciprocal value of a power related parameter, i.e., the parameter SPA, which under circumstances may also have values which are very small or even zero, the parameters $\alpha$ and $\Delta$ as used in the scale factors of formulas {6.1'}, - - - , {6.3'} and {6.4} are advantageous for providing enhanced controllability of the scaling operations. They are adjusted in a similar way as, but generally will differ from, the parameters as used in the scale factors according to the formulas {1'}, - - - , {3'} and {4}. For example, in the latter case, $\Delta$ has the dimension of power and should have a non-negligible value with respect to $P_{average}(X)$ (in {1'}) or to $P_{fixed}$ (in {2'} or {3'}), whereas in the former case $\Delta$ is a dimensionless number which may be simply put to be equal to one.

Hereinafter, a scale factor based on the SPA of a speech signal is called a T-type scale factor, while a scaling factor based on the $P_{average}$ of a speech signal is called an S-type scale factor.

Figure 5:
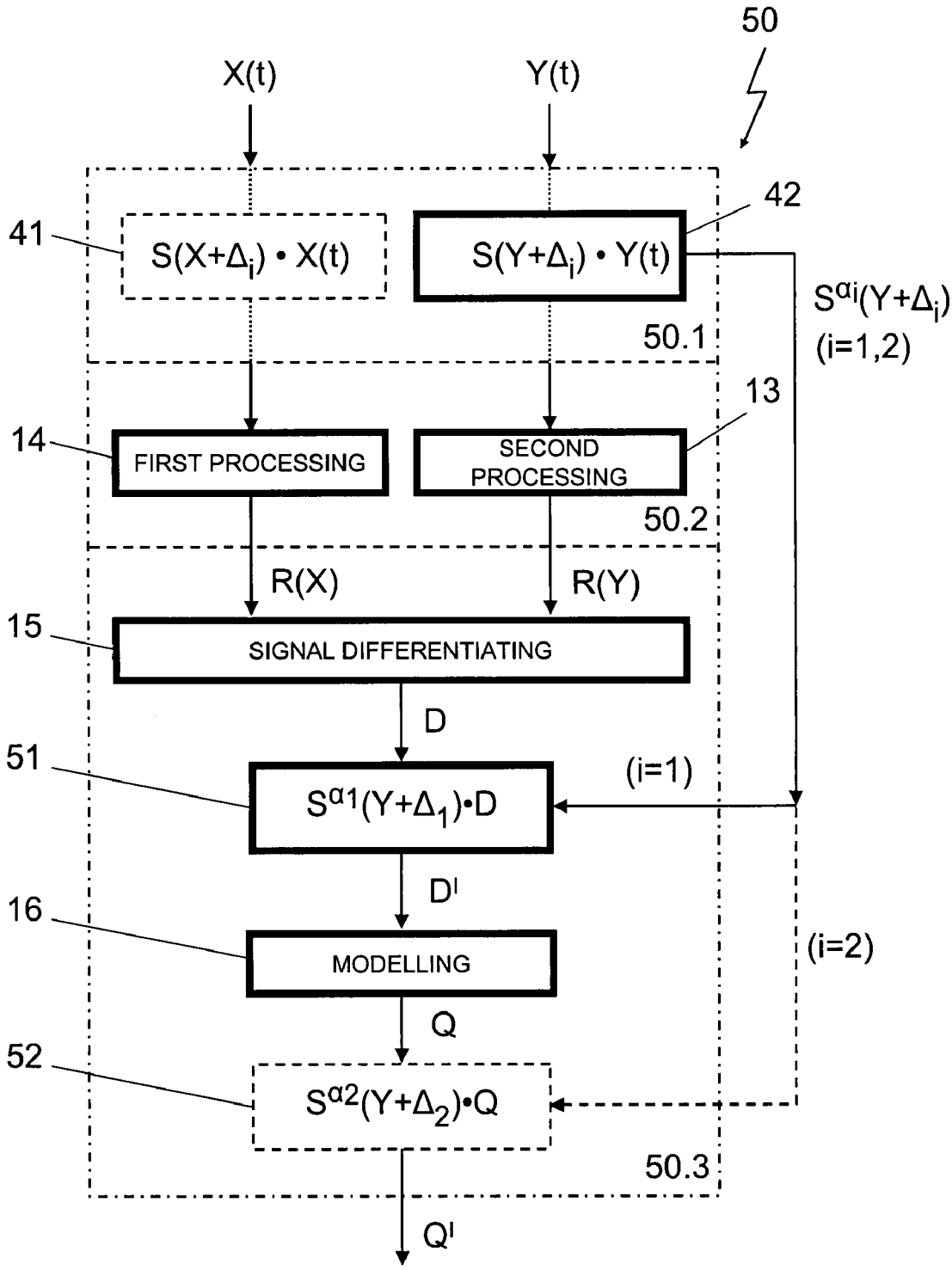
FIG. 5 shows a block diagram of a device for determining the quality of a speech signal according to the invention, including a variant of the device shown in FIG. 4.
Figure 6:
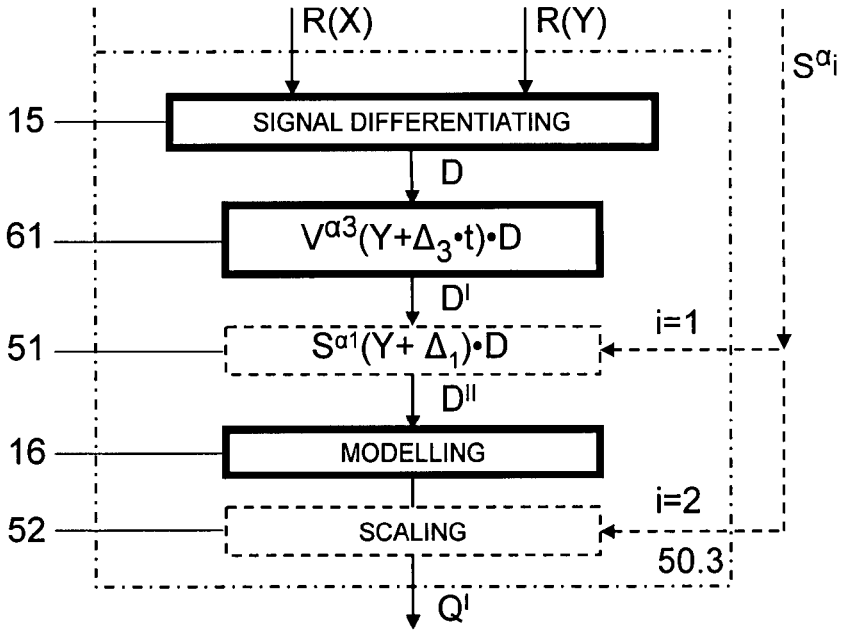
FIG. 6 shows, in a part of the block diagram of FIG. 5, a variant of the device shown in FIG. 5.

A T-type scale factor may be used instead of a corresponding S-type scale factor in each of the scaling operations described with reference to the figures FIG. 1 up to FIG. 5, inclusive.

The use of a T-type scale factor provides a solution for the problem of unreliable speech quality predictions in cases in which two different degraded speech signals, which are the output signals of two different speech signal processing systems under test, and which come from the same input reference signal, have the same value for the average power. If, e.g., one of the signals has relatively large power during only a relatively short portion of the total duration of the speech signal and extremely low or zero power elsewhere, whereas the other signal has relatively low power during the total duration, then such degraded signals may result in essentially the same prediction of the speech quality, whereas they may considerably differ in the actual subjectively experienced speech quality. Using a T-type scaling factor in such cases, instead of an S-type scaling factor, will result in different, and consequently more reliable predictions. However, since it is also possible that such two different degraded speech signals, instead of having the same value for the average power, have the same value for the signal power activity, and consequently may also result in unreliable predictions. In that case, it will be advantageous to use a scale factor which is a combination of an S-type and a T-type scale factors.

Various combinations are possible, such as a linear combination or a product combination of different or equal powers of an S-type and a T-type scale factors.

A preferred combination is the simple multiplication of one of the S-type scale factors with its corresponding T-type scale factor, as to define a corresponding U-type scale factor as follows:

$U_1=S_1\cdot T_1$, $U_2=S_2\cdot T_2$, $U_3=S_3\cdot T_3$, $U'_1=S'_1\cdot T'_1$, $U'_2=S'_2\cdot T'_2$, $U'_3=S'_3\cdot T'_3$, and $U_4=S_4\cdot T_4$.

Each of the thus defined U-type scale factors is to be used instead of a corresponding S-type scale factor in each of the scaling operations described with reference to the figures FIG. 1 up to FIG. 5, inclusive.

A second new scale factor is a function of a reciprocal value of a still different power related parameter, i.e., the instantaneous power of a speech signal. More particularly, it is derived from what may be called a local scale factor, i.e., a ratio of the instantaneous powers of the reference and output signals. The second new scale factor is achieved by averaging this local scale factor over the total duration of the speech signal, in which the adjustment parameters $\alpha$ and $\Delta$ are introduced already on the local level. A thus achieved scale factor, hereinafter called V-type scale factor, may be applied in a scaling operation carried out in the signal combining section 50.3 of the measurement device 50, instead of or in combination with one of the scaling operations carried out by the scaling units 51 and 52 with a substantially unchanged scaling operation carried out by the scaling unit 42 in the pre-processing section 50.1. There exist various possibilities for carrying out a scaling operation based on the V-type scale factor, depending on whether a local or a global version thereof is applied. Some of the possibilities are described now with reference to FIG. 6 and FIG. 7.

A local version $V_L$ of the V-type scale factor, in which already the two adjustment parameters have been introduced, is given by the following mathematical expression in equation (7.1):

$$V_L = V^{\alpha_3}(Y+\Delta_3, t) = \left(\frac{P(X(t))+\Delta_3}{P(Y(t))+\Delta_3}\right)^{\alpha_3} \quad \{7.1\}$$

in which P(X(t)) and P(Y(t)) are expressions for the instantaneous powers of the reference and degraded signals, respectively. The parameters $\alpha_3$ and $\Delta_3$ have a similar meaning as described before, but will have generally different values. This local version $V_L$ is applied to the time-dependent differential signal D in a scaling unit 61 between the differentiating means 15 and the modelling means 16 in the combining section 50.3, possibly in combination with the scaling operation as carried out by the scaling unit 51. Thereby, for the indicated averaging, the averaging which is implicit in the modelling means 16 is used.

A global version $V_G$ of the V-type scale factor is derived by averaging the local version $V_L$ over the total duration of the speech signal. Such averaging may be done in a direct way as given by equation (7.2) as follows:

$$V_G = V^{\alpha_3}(Y+\Delta_3) = \frac{1}{T}\int_0^T V^{\alpha_3}(Y+\Delta_3, t)dt \quad \{7.2\}$$

Figure 7:
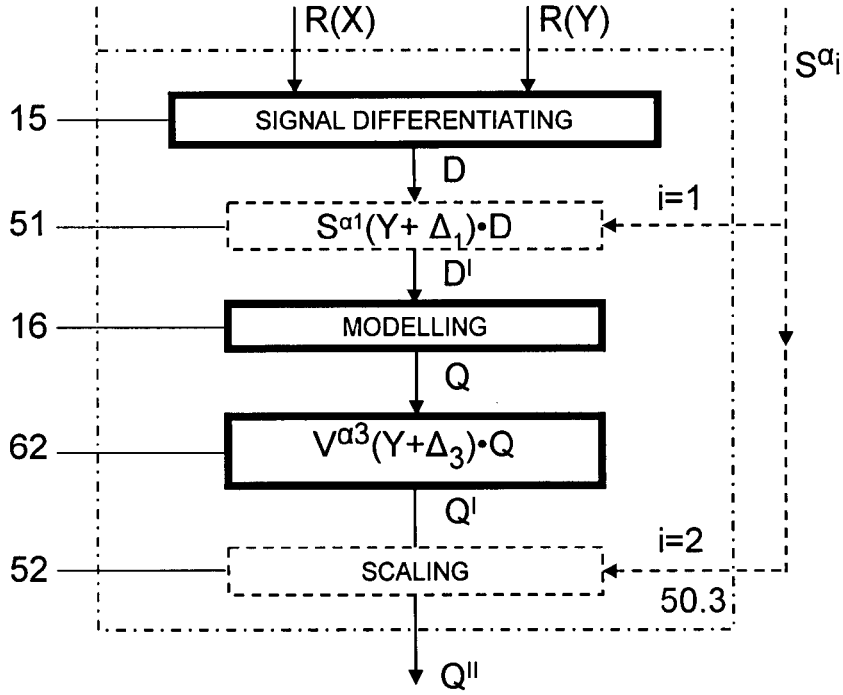
FIG. 7 shows, in a similar way as does FIG. 6, a further variant of the device shown in FIG. 5.

The global version of the V-type scale factor may be applied by a scaling unit 62 to the quality signal Q as outputted by the modelling means 16, resulting in a scaled quality signal Q', possibly in combination with, i.e., followed (as shown in FIG. 7) or preceded by, the scaling operation as carried out by the scaling unit 52, resulting in a further scaled quality signal Q".

Otherwise, the global version of the V-type scale factor may be applied by the scaling unit 61, instead of the local version of the V-type scale factor, to the differential signal D as outputted by the differentiating means 15, possibly in combination with, i.e., followed (as shown in FIG. 7) or preceded by, the scaling operation as carried out by the scaling unit 51.

The expressions {7.1} and {7.2} for the V-type scale factors are again given for continuous signal processing. Corresponding expressions suitable for cases of discrete signal processing may be obtained simply by replacing the various time-dependent signal functions by their discrete values per time frame and the integral operations by summing operations over the number of time frames.

The various suitable values for the parameters $\alpha_3$ and $\Delta_3$ are determined in a similar way as indicated above by using specific sets of test signals X(t) and Y(t) for a specific system under test, in such a way that the objectively measured qualities have high correlations with the subjectively perceived qualities obtained from mean opinion scores. Which of the versions of the V-type scaling factors and where applied in the combining section of the device, in combination with which one of the other types of scale factors, should be determined separately for each specific system under test with corresponding sets of test signals. In any event, the U-type scale factor is more advantageous in cases of degraded speech signals with portions of extremely low or zero power of relatively long duration with respect to the duration of the total speech signal, whereas the V-type scale factor is more advantageous for such signals having similar portions but of relatively short duration.

The invention claimed is:

1. Apparatus for determining, through an objective speech measurement technique, a quality signal for an output signal, of a speech signal processing system, with respect to a reference signal, the apparatus comprising:

means for pre-processing the output and reference signals to yield pre-processed signals;

means for processing the pre-processed signals so as to generate corresponding representation signals representing the output and reference signals according to a perception model, and means for combining the representation signals to form a differential signal and for generating, in response to the differential signal, the quality signal;

wherein the pre-processing means comprise:

first means for scaling a power level of at least one signal of the output and reference signals by multiplying said one signal by a first scale factor prior to generating the corresponding representation signal therefrom, the first scale factor being a first function of a reciprocal value of a first power-related parameter of the one signal, the first power-related parameter being adjusted by a first adjustment parameter ($\Delta$), to yield a first scaled signal; and second means for scaling the one signal, the differential signal or the first scaled signal through multiplication by a second scale factor so as to form a second scaled signal and thereafter using the second scaled signal instead of respectively the one signal, the differential signal or the first scaled signal, in subsequent processing to yield the quality signal, the second scale factor being a second function of a reciprocal value of a second power-related parameter of the one signal with the second power-related parameter being adjusted by a second adjustment parameter ($\alpha$).

2. The apparatus recited in claim 1 wherein the first scaling means comprise a unit for scaling the output signal through multiplication by the first scale factor, the first scale factor being a function of the first power-related parameter increased by a value corresponding to a third adjustment parameter.

3. The apparatus recited in claim 1 wherein the second scaling means is included in the pre-processing means and multiplies the one signal by the second scale factor.

4. The apparatus recited in claim 1 wherein the signal combining means comprise:

modelling means for processing the differential signal and generating the quality signal therefrom, and the second scaling means which multiplies one of the differential signal and the quality signal by the second scale factor.

5. The apparatus recited in claim 4 wherein the second scaling means comprise a unit for scaling said one signal by multiplying it by the second scale factor, and the first power-related parameter comprises an instantaneous value, of power of the output signal, increased by an adjustment value corresponding to the first adjustment parameter.

6. The apparatus recited in claim 1 wherein the first power-related parameter of the first scale factor comprises average power of the output signal.

7. The apparatus recited in claim 1 wherein the first power-related parameter comprises a total time duration during which the power of the output signal is greater than or equal to a predefined threshold value.

8. The apparatus recited in claim 1 wherein the first scale factor is formed as the reciprocal of the first function of a sum of a first predetermined value and the first power-related parameter, the first predetermined value being the first adjustment parameter; and the second scale factor is formed as the second function, of the reciprocal of the second power-related parameter of the one signal, raised to a second predefined value, the second predefined value being the second adjustment parameter.

9. A method for use in apparatus that determines, through an objective speech measurement technique, a quality signal for an output signal, of a speech signal processing system, with respect to a reference signal, the method comprising the steps of:

pre-processing the output and reference signals to yield pre-processed signals; generating, in response to the pre-processed signals, corresponding representation signals representing the output and reference signals according to a perception model; and combining the representation signals to form a differential signal and for generating, in response to the differential signal, the quality signal therefrom; and wherein the method further comprises the steps of:

first scaling a power level of at least one signal of the output and reference signals by multiplying said one signal by a first scale factor prior to generating the corresponding representation signal therefrom, the first scale factor being a first function of a reciprocal value of a first power-related parameter of the one signal, the first power-related parameter being adjusted by a first adjustment parameter ($\Delta$), to yield a first scaled signal; and second scaling the one signal, the differential signal or the first scaled signal through multiplication by a second scale factor so as to form a second scaled signal and thereafter using the second scaled signal instead of respectively the one signal, the differential signal or the first scaled signal, in subsequent processing to yield the quality signal, the second scale factor being a second function of a reciprocal value of a second power-related parameter of the one signal with the second power-related parameter being adjusted by a second adjustment parameter ($\alpha$).

10. The method recited in claim 9 wherein the first scale factor is formed as the reciprocal of the first function of a sum of a first predetermined value and the first power-related parameter, the first predetermined value being the first adjustment parameter; and the second scale factor is formed as the second function, of the reciprocal of the second power-related parameter of the one signal, raised to a second predefined value, the second predefined value being the second adjustment parameter.

11. The method recited in claim 10 wherein the second adjustment parameter has a value between zero and one.

12. The method recited in claim 10 wherein, when the output signal is scaled through the first scaling step, the first scale factor is a product of a fourth scale factor and a fifth scale factor, the fourth scale factor being a function of a reciprocal value of average power of the output signal increased by a first adjustment value corresponding to the first adjustment parameter, and the fifth scale factor being a function of a reciprocal value of a total time duration during which power of the output signal is greater than or equal to the threshold value increased by a first adjustment value corresponding to the second adjustment parameter.

13. The method recited in claim 9 wherein the first scale factor is a function of the first power-related parameter increased by a value corresponding to a third adjustment parameter.

14. The method recited in claim 13 wherein the second scale factor is derived from the first scale factor, the first and second power-related parameters are the same, and the second and third adjustment parameters are the same.

15. The method recited in claim 13 wherein the first power-related parameter comprises a component reflective of average power of the output signal increased by an adjustment value responsive to the third adjustment parameter.

16. The method recited in claim 15 further comprising the step of increasing said adjustment value by adding a noise signal having an average power, corresponding to the third adjustment parameter, to the output signal.

17. The method recited in claim 13 wherein the first scaling step comprises the step of scaling the reference signal by applying a third scale factor which is derived from the reference signal and in response to the first adjustment parameter.

18. The method recited in claim 9 wherein, when the second scaling step is performed on the first scaled signal, the second scaling step is performed as part of the first scaling step.

19. The method recited in claim 9 wherein the first power-related parameter reflects a total time duration during which power of the output signal is equal to or greater than a predefined threshold value.

20. The method recited in claim 19 wherein the total time duration in said first power-related parameter is reflected by a total number of time frames during which the power of the output signal is at least equal to the threshold value.

21. The method recited in claim 9 wherein the first power-related parameter comprises an instantaneous value, of power of the output signal, increased by an adjustment value corresponding to the first adjustment parameter.

22. The method recited in claim 21 wherein a global version of the second scale factor is applied to at least one of the differential and quality signals.

23. The method recited in claim 21 wherein the second scaling step is combined with a third scaling step by applying a third scale factor, derived from the first scale factor, to said one of the differential and the quality signals.

* * * * *